United States Patent [19]

Goltz

[11] 4,427,459

[45] Jan. 24, 1984

[54] PHOSPHATE CONVERSION COATINGS FOR METALS WITH REDUCED COATING WEIGHTS AND CRYSTAL SIZES

[75] Inventor: Kurt Goltz, Exton, Pa.

[73] Assignee: Pennwalt Corporation, Philadelphia, Pa.

[21] Appl. No.: 342,279

[22] Filed: Jan. 25, 1982

[51] Int. Cl.[3] ..... C23F 7/10

[52] U.S. Cl. ..... 148/6.15 R; 148/6.15 Z

[58] Field of Search ..... 148/6.15 R, 6.15 Z

[56] References Cited

U.S. PATENT DOCUMENTS

| | | | |
|---|---|---|---|
| 3,109,757 | 11/1963 | Reinhold | 148/6.15 |
| 3,214,454 | 10/1965 | Blaser et al. | 260/429.9 |
| 3,400,023 | 9/1968 | McDonald | 148/6.15 |
| 3,459,600 | 8/1969 | Sedlak | 148/6.16 |
| 3,630,790 | 12/1971 | Schmidt et al. | 148/6.15 R |
| 3,634,146 | 1/1972 | Wystrach et al. | 148/6.15 R |
| 3,668,138 | 6/1972 | Hoover et al. | 252/181 |
| 3,681,148 | 8/1972 | Wagenknecht | 148/6.15 Z |
| 3,699,052 | 10/1972 | Petrey et al. | 252/389 |
| 3,803,048 | 4/1974 | Hwa | 252/389 |
| 3,900,370 | 8/1975 | Germscheid et al. | 204/38 A |
| 3,957,543 | 5/1976 | Shinomiya et al. | 148/6.15 R |
| 3,977,012 | 8/1976 | Smadja et al. | 148/6.15 R |
| 4,000,012 | 12/1976 | Burrows et al. | 148/6.15 R |
| 4,057,440 | 11/1977 | Atkiss et al. | 148/6.15 Z |
| 4,138,353 | 2/1979 | Lipinski | 252/181 |
| 4,187,127 | 2/1980 | Yashiro et al. | 148/6.15 R |
| 4,213,934 | 7/1980 | Bellos et al. | 422/15 |
| 4,220,485 | 9/1980 | Howell et al. | 148/6.15 Z |

FOREIGN PATENT DOCUMENTS

| | | |
|---|---|---|
| 876250 | 8/1961 | United Kingdom . |
| 1386746 | 3/1975 | United Kingdom . |
| 1392044 | 4/1975 | United Kingdom . |

*Primary Examiner*—Sam Silverberg

[57] ABSTRACT

A method and material for forming phosphate conversion coatings on ferrous metals such as iron and steel or non-ferrous metals such as zinc and aluminum employes aqueous acidic solutions containing a metal phosphate such as zinc phosphate, an accelerator such as sodium nitrite, and a crystal refining material which is an acidic organic phosphate or phosphonate having at least one free alcoholic hydroxyl group and where the phosphate is derived from a cyclic or branched chain organic alcohol.

19 Claims, No Drawings

PHOSPHATE CONVERSION COATINGS FOR METALS WITH REDUCED COATING WEIGHTS AND CRYSTAL SIZES

BACKGROUND OF THE INVENTION

This invention relates generally to phosphate conversion coating for metals and more specifically to a process and material which forms conversion coatings having a reduced crystal size and coating weight by including certain phosphates and phosphonates which contain free alcoholic hydroxyl groups.

Phosphate conversion coatings on metals (i.e., steel and iron, zinc, galvanized steel, cadmium, and aluminum) are used for a variety of reasons. They are indispensible as adhesion promoters and they will improve the corrosion resistance for metal goods that have to be painted. They can also be used as a carrier base for a rust preventive oil, and they are used as lubricant carriers for metal cold forming operations and in lubricated bearings and other lubricated friction surfaces. Phosphate coatings are formed by contacting the metal surface with an acidic phosphate solution. The acid will dissolve some of the base metal and at the same time deposit an insoluble phosphate onto the surface. This is caused by the fact that the dissolution of the metal decreases the acidity near the surface area. To accelerate the speed of coating, the phosphate coating solutions (applied by immersion, spray, or roll-on) are mostly used at elevated temperatures and accelerators in the form of oxidizing compounds are added.

There are two basic types of phosphate solutions. The first one uses the dissolved base metal itself to form the phosphate coatings. It is essentially a dilute phosphoric acid solution with the acidity reduced to a somewhat lower level with an alkali and which contains an accelerator. These types of products are useful exclusively as a paint base, mainly for steel, and they are called iron phosphate coatings in the art. The coatings are flexible so that coil stock can be pre-painted and then formed without the paint cracking. However, painted goods using an iron phosphate base have less corrosion resistance than those having phosphate coatings of other types and therefore are not used in an outdoor environment or in other heavy duty applications.

The other type contains divalent metal salts that will form insoluble phosphates on a metal surface. The products most widely used contain acid zinc and zinc-nickel phosphates, but products using manganese, zinc-calcium and zinc-magnesium are also on the market. Of those six groups, the zinc and zinc-nickel phosphate compounds are the easiest to operate. They are used in all the afore-mentioned types of applications and are superior in corrosion resistance to iron phosphate under paint. Manganese and zinc-manganese phosphates are used as lubricant carriers in sliding friction service because of the superior hardness of these deposits. Zinc-magnesium phosphates do not have any advantage over zinc phosphates and are not widely used. Zinc phosphate, zinc-nickel phosphate, manganese phosphate, and zinc-manganese phosphate coatings are all of a more or less coarse crystalline structure. While this might be advantageous for some lubrication applications, where it is desirable to absorb a maximum of the lubricant on the surface, it is detrimental in most other applications, especially in under-paint service. Here it leads to a higher use of paint, the painted surface will be less glossy unless the paint thickness is increased above that necessary for an iron phosphate pretreatment, and especially important is that the metal cannot be bent anymore after painting because such bending or other deformation will result in the loss of paint adhesion. For this reason, only iron phosphate coatings can be used on prepainted coil stock, although zinc or zinc-nickel phosphate would result in a longer service life of the painted goods. The draw-backs of the coarse crystalline structure of phosphates other than iron phosphates for many applications have been recognized over the years and several methods have been used to overcome these problems.

One way to obtain a finer, denser crystal size uses a pretreatment prior to phosphate coating. Generally, metal parts to be phosphated with a crystal forming product have to be thoroughly cleaned beforehand. The most efficient way to do that is by using hot and strongly alkaline detergent solutions. A steel surface cleaned this way will result in especially coarse phosphate deposits. However, if the metal is rinsed with certain solutions before phosphating (mostly based on colloidal titanium phosphates), the deposits are finer and denser, although not fine enough to become flexible. Most phosphate coating lines for goods to be painted employ these pre-rinses (or, instead of an extra rinse, these compounds are added to the cleaning solution). These preconditionings of the metal surfaces are not sufficient to obtain micro-crystalline coatings.

The other approach has been to change the phosphate coating solution itself. One method is the use of a bath containing the above mentioned zinc-calcium phosphate. This method results in truly dense, micro-crystalline coatings. However, in spite of the good deposits obtained with zinc-calcium baths, they are not widely used, mainly because of inherent draw-backs. They are energy inefficient, as the baths have to be operated at relatively high temperatures. The baths form more scale on heating elements, tank walls, and piping than other baths, but mainly it is difficult to keep the baths in a good coating condition because of an inherent instability.

Another method to obtain micro-crystalline deposits is the addition of condensed phosphate salts, such as for example, sodium pyrophosphate, sodium tripolyphosphate, or sodium hexametaphosphate. A phosphate coating bath of this type is even harder to control than the zinc-calcium bath. Very small amounts (depending on temperature and concentration, 50–300 parts per million) of condensed phosphates are necessary to obtain micro-crystallinity. A small excess will stop the coating process completely. On the other hand, condensed phosphates are very instable in the acidic phosphate bath and under some conditions, might have a half life of only a few minutes, plus, they are used up rapidly in the coating itself. A line employing condensed phosphate additions would have to use microprocessor controls.

Another method that has been disclosed is the addition of glycerophosphoric acid and its salts. These chemicals result in a fairly good reduction of crystal size, although from my experience not as much as with the zinc-calcium phosphate products or zinc phosphate baths with condensed phosphate additions. The coating weigh reduction is only moderate. Such glycerophosphate baths are disclosed, for example, in British Pat. No. 876,250 and U.S. Pat. Nos. 3,109,757 and 3,681,148.

In my own experimentations, I needed between 0.8 and 1.5% by weight of the glycerophosphate compound in a phosphate coating bath. This approaches the concentration of the coating chemicals in the bath (i.e., zinc, phosphoric acid, and accelerators). The costs per weight unit of glycerophosphates are a magnitude higher than the ones of the coating chemicals. Also, straight chain aliphatic acid esters like glycerphosphoric acid are subject to de-esterification, which would make frequent replenishing necessary. Perhaps for these reasons, to my knowledge, such baths have had limited, if any, commercial use.

Sealing rinses which are applied after phosphating the metal are disclosed in U.S. Pat. No. 3,957,543 (an aqueous solution of technical grade phytic acid) and U.S. Pat. No. 4,220,485 (an aqueous solution of phosphoric acid; an acid soluble zinc compound; a heavy metal accelerator or a crystal refiner such as nickel or calcium nitrate, and a phosphonate corrosion inhibitor such as hydroxyethylidene-1,1-diphosphonic acid). In U.S. Pat. No. 3,900,370 anodized aluminum surfaces are sealed with a sealer including calcium ions and a water soluble phosphonic acid such as hydroxyethylidene-1, 1, -diphosphonic acid or its water soluble salt at temperatures of from 90° C. to the solution boiling point.

I have now found that such phosphorus containing compounds prove to be effective in significantly reducing crystal size and coating weight when used directly in the phosphate conversion coating forming baths as crystal refiners. They also provide phosphating baths which are easily controlled, which do not result in excessive scale formation, which are stable, and which can be operated at lower temperatures than previously required. The resulting coatings provide an excellent flexible paint base with good corrosion resistance despite the reduced coating weight. These compounds belong to the class of acidic, organic phosphates and phosphonates. More specifically, they all possess at least one free alcoholic hydroxyl group in the molecule. The phosphates used in this invention are acid esters of cyclic or branched aliphatic polyols.

SUMMARY OF THE INVENTION

In accordance with this invention there is provided a coating bath and a method of forming phosphate conversion coatings on metals. The coating bath comprises an aqueous acidic solution containing a divalent metal phosphate, an oxidizing accelerator, and a crystal refining material which is selected from the group consisting of acidic organic phosphates and phosphonates which have at least one free alcoholic hydroxyl group and where the phosphate is derived from a cyclic or branched chain organic alcohol.

The coatings are formed by contacting the metal surface with the heated solution of the invention.

DETAILED DESCRIPTION

The phosphate conversion coating baths of the invention can be used to form metal phosphate coatings on ferrous metals such as steel, galvanized steel, and iron and non-ferrous metals such as zinc, cadmium and aluminum. The baths are acidic, aqueous solutions which contain divalent metal phosphates. The metal ions used include zinc, zinc-nickel, zinc-magnesium, zinc-calcium, zinc-manganese and manganese, with the zinc and zinc-nickel phosphates being preferred. The baths are normally prepared from concentrated solutions of phosphoric acid and the metal ions. The concentrates are diluted with water and then adjusted by the addition of caustic to provide the desired ratio of total acid to free acid as is known in the art, phosphate ion concentrations of about 0.5 to 2.5% by weight, and metal ion concentrations of about 0.1 to 0.5% by weight.

Accelerators in the form of oxidizing materials are added to provide rapid coating formation. The most commonly used accelerators are alkali metal nitrites or chlorates but other oxidizers such as nitrates, peroxides and oxygen can also be used.

The phosphates and phosphonates which are useful in the practice of the invention are acidic, organic phosphates which include a free alcoholic hydroxyl group. The phosphates are derived from cyclic or branched chain alcohols which provide compounds with improved performance and stability. Specific examples of suitable materials include:

a. mixed esters of pentaerythritol acid phosphates. Pentaerythritol is a tetrol, i.e., an alcohol with a hydroxide on each of its four branches and has an extremely compact molecule of very high stability. The esters prepared are a mixture of different compounds, which are not separated prior to use.

b. mixed esters of N,N,N',N'-tetrakis-(2-hydroxylpropyl)-ethylenediamine acid phosphate. The alkanolamine from which these esters are prepared is sold by BASF-Wyandotte Co. under the brand name Quadrol®.

c. technical grade phytic acid. This is a natural occurring chemical extracted from cereal hulls and brans. Pure phytic acid is inisotol hexaphosphoric acid i.e. the hexa-acid phosphate ester of a hexahydroxy cyclohexane. However, the natural product is a mixture of esters containing from 2–6 phosphates in the molecule so that free alcoholic hydroxyl groups are present.

d. a very effective and preferred compound belongs to the group of alkanol phosphonates. It is 1-hydroxyethylidene-1,1-diphosphonic acid, sold by the Monsanto Co. under the brand name of Dequest® 2010.

The compounds should be added to the coating baths as metal chelates rather than the free acidic compounds. When the free compounds are added, some difficulties in start-up occur, which can be overcome by adding alkali to the coating bath. This in turn results in the precipitation of some basic zinc compounds that can be chelated in the bath. Expecially the free Dequest 2010 Phosphonic acid compound is hard to adjust. After adding it to a bath, it normally stops coating completely. These difficulties are avoided by adding the materials in the form of their chelates. Zinc chelates work satisfactorily; however, calcium chelates seem to work better.

The above specific materials were chosen as examples because either they or the raw materials from which they are prepared are available in commercial quantities. Compounds of similar structure would be expected to provide similar results and such alcoholic hydroxyl compounds of similar structure are included in the scope of the invention. For example, U.S. Pat. No. 3,214,454, whose teachings are incorporated by reference, discloses hydroxy diphosphonates where the alkyl chain contains from 1 to 5 carbon atoms. The presence of other polar groups besides hydroxyl in the molecule such as cyano and amine groups also aids in providing a reduced crystal size.

The effective amounts of crystal refiner will depend upon a number of factors including the additive itself, the bath composition and the application involved. Amounts of from about 0.025 to about 3.5 grams per liter of solution have been successfully employed.

The invention permits the coating weights required to provide a good continuous coating to be reduced to below 100 mg/ft$^2$ from the normally required coating weights of 200 mg/ft$^2$ or greater. Crystals in the microcrystalline range (<4 micron) can be easily achieved and processing temperatures can be reduced from 15° to 20° C. from these required without the crystal refiner of the invention.

In using coating solutions containing the crystal refiners, the control points of the bath have to be changed from the ones normally prevailing in a bath without the additives.

A zinc phosphate bath is controlled regularly by three titrations: total acid points, free acid points and in most cases, the accelerator points. By convention in the art, the total acid points are the number of milliliters of 1/10 normal sodium hydroxide solutions necessary to neutralize a ten milliliter bath sample to the phenolphthalein endpoint, and the free acid points are the number of milliliters of 1/10 normal sodium hydroxide necessary to neutralize a ten milliliter bath sample to the bromophenol blue or methylorange endpoint. These two endpoints coincide roughly with the neutralization of the second and the first hydrogen ions respectively of the phosphoric acid in the bath.

A zinc phosphate bath is operated at a very delicate balance of zinc, phosphate, and acid, and close to the precipitation point of the very insoluble hopeite. Any decrease in acidity would start precipitation of zinc phosphate which in turn would free some acid. In other words, the acidity in a well run bath is self-stabilizing. Therefore, the acid ratio of a particular bath, i.e. the number obtained by dividing the total acid points by the free acid points, is fairly constant. Its value is a function of the concentration and temperature. The higher the temperature and concentration, the lower the acid ratio.

When a crystal refiner is added to a balanced coating bath, the acid ratio has to be increased in order to obtain satisfactory coatings. Depending on the type and amount of crystal refiner, a new, higher acid ratio will stabilize. Generally, with the baths of the invention, acid ratios of about 12 to about 50 are employed at operating temperatures of from about 35° to about 70° C. Higher ratios and temperatures can be used but are not needed. The higher acid ratios indicate a lower amount of free acid which would result in a slow down of coating reaction. Therefore, it is found necessary to increase the accelerator points (i.e., the amount in milliters of 0.05 normal $KMnO_4$ needed to titrate a 25 cc bath sample to a pink endpoint where each point is equivalent to one ounce of sodium nitrite per 100 gallons of bath) in the bath for this reason. Amounts of accelerator of about 5 to 50 milliequivalents per liter are effective in providing rapid coating.

The baths are applied to the metal surfaces by conventional means such as dipping, roller coating and spraying.

A way of determining the grain refiner additive concentration so that it can be controlled to provide for practical operation of the coating baths was found which constitutes a separate invention. The technique involves a chemical oxygen demand (COD) determination as described, for example, in *Standard Method for the Examination of Water and Waste Water,* 14th Edition, page 550, jointly published by the American Public Health Assn., American Water Works Assn. and the Water Pollution Control Federation. The Hach Chemical Co. test kit for COD determination can be used. According to the method, the COD value of the grain refiner can be determined by either a titrimetric or colorimetric method. A COD reactor (115/230 V, 50/60 Hz Hach Company, Loveland, Colorado) is preheated to 150° C. Two 100 ml samples of the phosphate bath are heated almost to boiling and 10 ml of zinc sulfate solution (50 gms $Zn(SO_4).7H_2O$ in 100 ml water) are added to each. Using a pH meter standardized at pH 7 for 100° C., 50% w/w NaOH solution is slowly added to bring the pH of each solution to 6.5. The solution is then allowed to cool and settle. A 2 ml sample of the clear liquid is pipetted from each sample and carefully added to COD digestion vials (low range 0–150 mg/l from Hach Company) which contain sulfuric acid and mercuric salts. A blank is run using 2 ml of D.I. water. The 2 ml samples of unprecipitated, filtered phosphate bath are added to COD digestion vials. The capped vials are shaken to mix the contents and then placed in the COD reactor and heated at 150° C. for two hours, cooled below 120° C. and removed from the reactor.

A COD vial adaptor is placed in the cell holder of a DR/2 spectrophotometer and the wavelength is set at 420 nm. A COD meter scale is inserted into the meter, the meter light switch is held in the zero check position, and the zero adjust is turned until the meter needle is on the extreme left mark on the scale. The switch is then returned to the on position. The vial with the blank solution is placed in the meter and the light control adjusted for a meter reading of zero mg/l. Each test sample in turn is placed in the meter and the mg/l COD is read from the meter scale.

The COD value in mg/l of the grain refiner is the difference between the COD value of the unprecipitated phosphate bath and the COD value of the precipitated sample.

The COD test results measure the amount of oxygen needed to oxidize the grain refiner to $CO_2$ and water and the amount of grain refiner in the sample is then calculated as is known in the art.

The COD of the digested samples can also be determined titrimetrically with 0.0125 N ferrous ammonium sulfate reagent.

In order to provide the optimum crystal refining, the metal surface to be coated is first cleaned and then activated using a colloidal titanium phosphate treatment which can be applied separately or in combination with the cleaning bath.

The invention is further illustrated by, but is not intended to be limited to, the following examples, wherein parts are parts by weight unless otherwise indicated.

EXAMPLE 1

Coating baths containing mixed esters of pentaerythritol were prepared and used to coat mild carbon steel panels. The mixed esters were first prepared as follows: 30 grams of finely powdered pure grade pentaerythritol were dispersed in 100 grams of dry pyridine in a glass flask under stirring. In another flask, 100 grams of pyridine were ice cooled, and, under stirring and with continuous cooling, 44 grams of phosphorus oxychloride were slowly added. A white precipitate formed. Next, the pentaerythritol dispersion was ice cooled also, and slowly, under steady stirring, the phosphorus oxychloride adduct was added. After four hours of stirring, the flask with the reaction product was placed in a refrigerator for two days. Then, the content was immediately poured into 2 liters of ice water. The batch in a four liter beaker was left uncovered under a fume hood and about half of the liquid (water and excess pyridine) evaporated. The remaining liquid was slightly acidic. Seventy-nine grams of calcium hydroxide (powder) were then added and the mixture was stirred for several days. The pH went up to 12, i.e. highly alkaline, which freed all the pyridine. A precipitate formed. The pyridine apparently evaporated completely within one week. Next, the pH was lowered with hydrochloric acid to about 9.5. The batch was filtered and the filtrate checked for alcohol insolubles, which was negative. Thereafter, the washed residue was redispersed in water and hydrochloric acid was added which dissolved the precipitate completely at a pH of 7. Into the solution, about a three times excess of ethyl alcohol was added. Immediately, a crystalline precipitate formed which was washed with alcohol and ether. The yield was 30 grams. Elemental analysis indicated that the product consisted of mixed phosphate esters of pentaerythritol. No attempt was made to separate the components of the mixture.

A five liter aqueous thirteen point total acid coating bath was prepared from a commercial zinc phosphate concentrated product having a composition of by weight (with the balance being water):

40.9% $H_3PO_4$
6.1% Zn and
2.8% Ni by adding 125 grams of concentrate to water. The acid ratio was adjusted to 14 by adding a slurry of zinc carbonate in water, the temperature was kept at 60° C. Sodium nitrite (about 1.8 grams initially) was added as the accelerator. Its level was kept between 5 and 10 milliequivalents per liter (3 to 4 points) by monitoring and replenishing it periodically because the nitrite slowly decomposes in the acid bath. Clean mild carbon steel panels (SAE 1010) were spray coated with solutions to which various amounts of the mixed esters of pentaerythritol acid phosphate prepared above were added as shown in Table I.

TABLE I

| Amount of Additive | Microscopic Inspection | Coating Weight |
|---|---|---|
| 0 grams/l | crystalline, approaching 100μ | 372 milligrams/ft$^2$ |
| 0.2 grams/l | no change | 349 milligrams/ft$^2$ |
| 0.75 grams/l | crystals flattened and denser | 288 milligrams/ft$^2$ |
| 1.5 grams/l | mostly micro crystalline | 258 milligrams/ft$^2$ |
| 3.0 grams/l | completely micro crystalline (<4μ) | 163 milligrams/ft$^2$ |
| 3.5 grams/l | completely micro crystalline (<4μ) | 134 milligrams/ft$^2$ |
| 4.5 grams/l | too thin, incomplete coating | 33 milligrams/ft$^2$ |
| 6.0 grams/l | very thin, incomplete coating | 14 milligrams/ft$^2$ |

The reduction in coating weights and crystal size obtained by the use of the crystal refiner are apparent from the results reported in Table I.

EXAMPLE 2

Coating baths were prepared and used to coat steel panels with different ester fractions of mixed pentaerythritol acid phosphates which was prepared as follows: 385 g of phosphorus oxychloride ($PClO_3$) were dropped slowly into 500 ml of dimethyl formamide under cooling and stirring; 500 g of pentaerythritol technical grade (about 10% di- and tripentaerythritol in the product) were dispersed in a mixture of 1500 ml of dimethyl formamide (DMF) plus 725 g of triethylamine. Under stirring and cooling the $POCL_3$-DMF was slowly dropped into the pentaerythritol dispersion within 70 minutes at 0° to 5° C. Within the next 80 minutes, the temperature went down to −5° C. The batch was stirred overnight and the temperature went up slowy to ambient. After 16 hours, the batch was poured into 4 liters of deionized water. Some precipitate formed. Three hundred grams of calcium chloride in 2 liters of water was added. The pH of the batch was 7, i.e. neutral. Because of some voluminous precipitate, the batch was diluted to 20 liters and let stand overnight for settling. The next day, the clear liquid on the top was decanted, and the precipitate ($P_1$) filtered, washed several times with hot water and dried at 130° C. A 72.2 g yield of $P_1$ (a pale yellow powder) was obtained. $M_1$ (the filtrate of $P_1$) plus the decanted liquid was boiled down to 5 liters. More precipitate formed ($P_2$), which was filtered, washed and dried the same as $P_1$. A 134 g yield of $P_2$, a light gray powder, was obtained. $M_2$, (the filtrate of $P_2$), was boiled down until a crystal mush formed. Water was added again. An insoluble residue remained. The residue ($P_3$) was filtered, washed and dried as before. A 29.6 g yield of $P_3$ was obtained. $M_3$ was mixed with 2 gallons of 95% ethyl alcohol. A new precipitate (the filtrate of $P_3$) formed ($P_4$) and was filtered and dried. A 13.7 g yield of $P_4$ was obtained. Another four gallons of ethyl alcohol was added to $M_4$ (the filtrate of $P_4$). The formed precipitate ($P_5$) was filtered and dried. A 55.5 g yield of $P_5$ was obtained. The filtrate was discarded.

All five precipitates were tested in a zinc-nickel phosphate coating solution prepared from a concentrate having a composition of by weight (with the balance being water):

31.5% $H_3PO_4$,
4.1% $HNO_3$,
6.9% Zn,
3.1% Ni,
1.0% HF.

by adding 125 grams of concentrate to form 5 liters of solution. The acid ration was adjusted to 13 points total acid to free acid. The bath was accelerated with sodium nitrite and operated at a temperature of 57° C. Clean SAE 1010 cold rolled steel panels were spray coated for one minute. Of the five precipitates, $P_1$ and $P_2$ were highly active, $P_3$ was still fairly good, $P_4$ was somewhat active, and $P_5$ was inactive. The control panels without additives had coating weights from 360 to 410 mg/ft$^2$ and crystal sizes of 10 to 15μ with the crystals partly protruding upward from the surface. An amount of 0.5 g/l of $P_1$ brought the coating weight down to 160 mg/ft$^2$ and the crystal size was less than 1μ. 1.5 g/l of $P_2$ had the same effect. Coating weight here was 154 mg/ft$^2$. 3.5 g/l of $P_3$ resulted in a 260 mg/ft$^2$ coating weight and very flat crystals of 2μ. 2.5 g/l of $P_4$ resulted in a 235 mg/ft$^2$ coating weight and fairly flat crystals of 8μ. The acid ratio in the control bath was stabilized at around 16; with the different grain refiners, acid ratios of 22.5 to 32.5 stabilized. The higher activity of this batch of ester compared to the esters prepared in Example 1 might be due to the presence of the di- and tripentaerythritol with their greater number of hydroxyl groups in their molecules.

EXAMPLE 3

A coating bath containing an addition of mixed esters of N,N,N',N'-tetrakis-(2-hydroxypropyl)-ethylenediamine acid phosphate was prepared and used to coat steel panels. The mixed ester were prepared as follows: 100 g of Quadrol (N,N,N',N'-tetrakis (2-hydroxypropyl)-ethylenediamine were mixed with 100 ml of dimethyl formamide. Fifty three grams of phosphorus pentoxide were dispersed in another 250 ml of dimethyl formamide. Under steady stirring, the $P_2O_5$-DMF mixture was poured into the amine-DMF within 0.5 hours. The temperature rose briefly to 40° C. The batch was stirred for 2.0 hours at room temperature, heated up to 80° C. within 0.5 hours and then stirred for another 2.0 hours at this temperature. The heat was the removed and the batch was left standing overnight. The content split into two phases. The upper layer was mostly solvent. Mixing with 4 to 5 times the volume of methylene chloride yielded 6.8 g of a precipitate which was not further investigated. The lower phase was a sticky, almost solid, transparent, resinous material of amber color. The yield of resinous material was 192 g. The resinous material was tested in a phosphate coating bath formed by adding 125 grams of the following concentrate by weight with the balance being water: to make 5 liter bath:

$H_3PO_4$—36.3%,
$HNO_3$—3.6%,
HF—0.7%,
Zn—9.7%,
Ni—1.2%.

The total acid was adjusted to 13 points and the accelerator was 3–4 points. 2.5 g/l of the crystal refiner at a temperature of 57° C. resulted in a coating weight on steel panels of 116 mg/ft$^2$ and a crystal size of less than 2$\mu$.

EXAMPLE 4

Twenty grams of a 50% solution of a technical grade of phytic acid was neutralized with sodium hydroxide. A large excess of calcium chloride was added. A precipitate formed which was filtered and washed chloride free, then dried at 105° C. The yield was 12.8 g.

The compound was made into a slurry and added to a 6 liter zinc-nickel phosphate bath formed by adding 210 grams of the concentrate of Example 4 to water. The bath was nitrite accelerated. The bath had a total acid content of 22.7 points and an acid ratio of 32.4 points. Cleaned steel test panels were first dipped in a titanium phosphate activation solution (Actidip® sold by Pennwalt used at 0.5 ounces/gallon of water). With a one minute spray at a temperature of 38° C., a completely microcrystalline, well adhering coating was obtained on a steel test panel.

EXAMPLE 5

166 grams of hydroxyethylidene-1,1-diphoshonic acid and were dissolved in 3.5 liters of water. 130 g of calcium hydroxide were dissolved in an excess of nitric acid. This solution was poured into the phosphonic acid solution. The batch was heated to a boil, and then, ammonium hydroxide solution was added to a pH of 7–8. The precipitate was filtered, washed and dried three hours at 130° C. The yield of chelated acid was 144 g.

Several coating solutions were made up from a concentrate having the following composition by weight (with the balance being water):

$H_3PO_4$—36.3%,
$HNO_3$—3.6%,
HF—0.7%,
Zn—9.7%.
NI—1.2%.

Solutions ranging in concentration from 17–25 total acid points, nitrite accelerator concentrations of 5–25 milliequivalents, and temperatures of 38°–54° C. were mixed with 50 to 200 parts per million of the phosphonate crystal refiner. The acid ratios stabilized at around 30 after the addition of sodium hydroxide. SAE 1010 clean steel panels were spray or immersion coated with these solutions after a prior dip in the titanium activator solution. Excellent microcrystalline coatings of 70–140 mg/ft$^2$ were obtained in one minute with the immersion coatings being somewhat heavier than the spray coatings.

EXAMPLE 6

A chlorate accelerated bath was made up from the following concentrate by weight (with the balance being water):

$H_3PO_4$—29.5%,
$HNO_3$—8.4%,
HF—1.0%,
Zn—9.2%,
$NaClO_3$5.0%.

125 mg/l of the crystal refiner of Example 5 were added to the bath having a concentration of 25.8 points total acid and the acid ratio was adjusted with sodium hydroxide to 13.6. At 54° C., titanium activated SAE 1010 steel panels were immersion coated for one minute. Completely microcrystalline coatings were obtained. In a one minute spray application, a fairly fine, crystalline coating was obtained. Chlorate accelerated phosphate coating solutions as a rule need higher temperatures than nitrite accelerated solutions. This particular chlorate bath without the crystal refiner of the invention is normally applied at 71° C. and results in medium to large crystal sizes and is not well suited for spray applications.

EXAMPLE 7

A sodium nitrite accelerated bath was made up from the following concentrate having a composition of by weight (with the balance being water):

$H_3PO_4$—33.2%,
$HNO_3$—9.5%,
Zn—12.8%,
HF—1.0%.

a 25 gallon spray coating bath was made by adding 2600 grams of the concentrate to water and the bath was run at about 12 total acid points, an acid ratio of 40 to 1 and 4 to 10 accelerator points. Hydroxyethylidene-1,1,-diphosphonic acid calcium chelate (0.040 grams/l) were added as the grain refiner. Mild cold rolled carbon steel (SAE-100) panels (12"×4") were cleaned, dipped in a 3.6 oz/gal or 0.1% titanium phosphate activator solution and spray coated for one minute at 38° C. at a spray pressure of 10 psi. After coating (coating weights 136–164 mg/f$^2$) the panels were water rinsed and received a final rinse of chromichromate having a dichromate concentration of about 0.024% and a chromic concentration of 0.016%. The dry panels were then spray painted with one coat (about 0.001 inch) of DuPont Co. Hi-Bake alkyd mar resistant enamel #707-6741 and oven cured according to manufacturer's specifications. The panels were impact, bend, and corrosion tested along with phosphate coated panels which did not contain the grain refiner (coating weight 250 mg/ft$^2$). In an impact test at 160 inch pounds no effect was observed on the coating of Example 7 from direct and reverse blows (a 10.0 rating). The control panel results were 8.3 direct and 5.8 reverse. For the 180° mandrel bend test (ASTM D522) the panels coated with the grain refiner of the invention gave results of 9.9 to 10 with the control panels slightly lower at 9.6.

Control panels using zinc-calcium coatings at a high and low coating weight were rated at 9.9–10 in the bend test, had direct direct impact ratings of 10.0 and 9.8 but reverse impact ratings of only 6.0 and 6.5.

Panels were tested for corrosion in a salt spray according to ASTM B117-79 at 38° C. for 500 hours. The corrosion was 0.078 inches for the panels of Example 7 and 0.094 inches for the control panels.

The control panels with the zinc-calcium coating gave for a low coating weight 0.070 inches and for a high coating weight 0.078 inches. The panels of Example 7, coated at low temperatures of 38° C. were, therefore, comparable to zinc-calcium coated panels which were high temperature coated at 77° C.

The panels of the invention and the control panels were tested for water immersion, ASTM D870-79, and humidity ASTM D2247-79 at 38° C. for 500 hours and showed no adverse effect.

Panels coated with the phosphate solution of Example 5, coating weight 150 mg/ft$^2$, showed better impact resistance (10.0 and 9.7 forward and reverse) than those which did not have the grain refiner, coat weight 200/mg ft$^2$, (9.8 and 6.7) but had a corrosion result of 0.094 meters vs. 0.055 inches.

Baths using glycerophosphate grain refiner additions were used with the concentrate of Example 1 in a 13 point bath at 130° F. At a 3.6 g/l glycerophosphate level, the coating weight was above 250 mg/ft$^2$ and at 5.4 g/l the coating weight was 158 mg/ft$^2$ but the deposit was still not microcrystalline. A parallel series of trials using a pentaerythritol phosphate additive at a 3 g/l concentration was sufficient to bring down the coating weight to 163 mg/ft$^2$ with completely microcrystalline deposits.

The composition and process of the invention, therefore, provides microcrystalline phosphate conversion coatings which have improved qualities of impact resistance, and in the preferred embodiments comparable properties of corrosion resistance at lower coating weights. The coatings can be formed at lower temperatures with baths of high stability.

I claim:

1. In an acidic aqueous composition for forming a metal phosphate conversion coating which composition comprises a divalent metal phosphate, wherein the divalent metal is selected from the group consisting of zinc, zinc-nickel, zinc-magnesium, zinc-calcium, zinc-manganese and manganese, an oxidizing accelerator, and a crystal refiner, the improvement wherein the crystal refiner comprises a material selected from the group consisting of chelates of acidic organic phosphates and phosphonates which have at least one free alcoholic hydroxyl group and where the organic phosphate is derived from a cyclic or branched chain organic alcohol.

2. The composition of claim 1 having an acid ratio of from about 12 to about 50.

3. The composition of claim 1 wherein the accelerator is selected from the group consisting of alkali metal nitrite and chlorate.

4. The composition of claim 1 wherein the crystal refiner includes a pentaerythritol acid phosphate.

5. The composition of claim 1 wherein the crystal refiner includes a N,N,N′,N′-tetrakis-(2-hydroxypropyl)-ethylenediamine acid phosphate.

6. The composition of claim 1 wherein the crystal refiner includes a hexahydroxy cyclohexane acid phosphate.

7. The composition of claim 1 wherein the crystal refiner includes a chelate of 1-hydroxyethylidene-1,1-diphosphonic acid.

8. The composition of claim 1 wherein the metal chelate is selected from the group consisting of calcium and zinc.

9. The composition of claim 1 wherein the crystal refiner is present in an amount of at least about 0.025 grams per liter of composition.

10. A process for forming a metal phosphate conversion coating on a metal surface comprising contacting the surface with a heated, acidic, aqueous composition comprising a divalent metal phosphate, wherein the divalent metal is selected from the group consisting of zinc, zinc-nickel, zinc-magnesium, zinc-calcium, zinc-manganese and manganese, an oxidizing accelerator, and a crystal refiner, the improvement wherein the crystal refiner comprises a material selected from the group consisting of acidic organic phosphates and phosphonates which have at least one free alcoholic hydroxyl group and where the organic phosphate is derived from a cyclic or branched chain organic alcohol.

11. The process of claim 10 wherin the accelerator is selected from the group consisting of alkali metal nitrite and chlorate.

12. The process of claim 10 wherein the crystal refiner includes a pentaerythritol acid phosphate.

13. The process of claim 10 wherein the crystal refiner includes a N,N,N′,N′-tetrakis-(2-hydroxypropyl)-ethylenediamine acid phosphate.

14. The process of claim 10 wherein the crystal refiner includes a hexahydroxy cyclohexane acid phosphate.

15. The process of claim 10 wherein the crystal refiner includes a chelate of 1-hydroxyethylidene-1,1-diphosphonic acid.

16. The process of claim 10 wherein the crystal refiner is in the form of a metal chelate.

17. The process of claim 16 wherein the metal chelate is selected from the group consisting of calcium and zinc.

18. The process of claim 10 wherein the crystal refiner is present in an amount of at least about 0.025 grams per liter of composition.

19. The process of claim 10 wherein the acid ratio of the aqueous composition is from about 12 to about 50 and its temperature is from about 35° C. to about 70° C.

* * * * *